US009541091B2

(12) United States Patent
Wilson et al.

(10) Patent No.: US 9,541,091 B2
(45) Date of Patent: Jan. 10, 2017

(54) INSTRUMENT SUBS FOR CENTRIFUGAL WELL PUMP ASSEMBLIES

(71) Applicant: Baker Hughes Incorporated, Houston, TX (US)

(72) Inventors: Brown Lyle Wilson, Tulsa, OK (US); Ketankumar K. Sheth, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 437 days.

(21) Appl. No.: 14/079,266

(22) Filed: Nov. 13, 2013

(65) Prior Publication Data

US 2015/0132159 A1 May 14, 2015

(51) Int. Cl.

| | |
|---|---|
| ***F04D 13/08*** | (2006.01) |
| ***F04D 13/10*** | (2006.01) |
| ***E21B 47/06*** | (2012.01) |
| ***F04D 13/06*** | (2006.01) |
| ***E21B 47/01*** | (2012.01) |
| ***E21B 43/12*** | (2006.01) |
| ***F04D 29/42*** | (2006.01) |

(52) U.S. Cl.

CPC ..... *F04D 13/0693* (2013.01); *E21B 43/128* (2013.01); *E21B 47/011* (2013.01); *E21B 47/06* (2013.01); *F04D 13/08* (2013.01); *F04D 13/10* (2013.01); *F04D 29/426* (2013.01)

(58) Field of Classification Search

CPC ..... F04D 13/08; F04D 13/10; E21B 43/128; E21B 47/06; E21B 47/011

USPC ..... 417/422, 423.3, 424.2

See application file for complete search history.

(56) References Cited

U.S. PATENT DOCUMENTS 7,658,227 B2 * 2/2010 Fox ..... E21B 43/128 166/250.01

2013/0148127 A1 6/2013 Sheth et al.

* cited by examiner

*Primary Examiner* — Peter J Bertheaud

(74) *Attorney, Agent, or Firm* — Bracewell LLP; James E. Bradley

(57) ABSTRACT

An electrical submersible pump assembly has a centrifugal primary pump having a primary pump housing. An electrical motor is operatively coupled to the primary pump. An instrument sub has a housing secured by threaded fasteners to one end of the primary pump housing. A pump stage in the instrument sub housing is driven by the electric motor along with the primary pump, the pump stage including an impeller and a diffuser. A sensor within the instrument sub monitors parameters in the instrument sub. A sensor line port extends through a wall of the instrument sub housing. A sensor line extends sealingly through the sensor line port to the sensor for conveying sensed information from the sensor to a remote instrument panel.

20 Claims, 4 Drawing Sheets

INSTRUMENT SUBS FOR CENTRIFUGAL WELL PUMP ASSEMBLIES

FIELD OF THE DISCLOSURE

This invention relates in general to electrical submersible well pump assemblies and in particular to instrument subs that mount to a centrifugal pump.

BACKGROUND

Electrical submersible pump assemblies are commonly used in hydrocarbon producing wells to pump well fluid. These assemblies include a rotary pump driven by an electrical motor. A seal section coupled between the pump and motor reduces a pressure differential between well fluid and motor oil or lubricant contained in the motor and part of the seal section. Usually, a string of production tubing supports the submersible pump assembly in the well. A drive shaft extends from the motor through the seal section to the pump.

Instruments to measure various operating parameter of a submersible pump assembly are commonly used. The instruments are normally mounted in a sub attached to a lower end of the motor. In this position, electrical power for the instruments can come from an electrical lead extending to a neutral point for the three phases of windings in the motor. The signals can be superimposed on the three power conductors leading to the wellhead. These instruments measure motor parameters and only indirectly pump parameter as the pump may be some distance above the motor.

Proposals to measure parameters directly in the pump are also known, using both electrical or electronic sensors as well as fiber optic sensors. Mounting sensors within the pump, however, is a difficult task because of the length of the pump and the number of stages. Extending a sensor wire or line to the instrument sub at the bottom of the motor presents problems. The pump housing may not be thick enough for sensor wire ports and passageways to be formed in it.

Separate sensor wires or lines apart from the conductors in the power cable for sensing electrical submersible pump assembly conditions are known. It is difficult, however, to route the sensor wires to various points within a lengthy pump.

SUMMARY

In this disclosure, at least one instrument sub is releasably secured to one end of the pump above an intake of the pump. The instrument sub has at least one pump stage comprising an impeller and a diffuser configured for pumping well fluid. At least one sensor is located within the instrument sub for monitoring parameters in the instrument sub. A sensor line extends sealingly through a sensor line port in the instrument sub to the sensor for conveying sensed information from the sensor to a remote instrument panel. Instrument subs may be mounted both to the upper end, to the lower end of the pump and/or between the two sections of the pumps.

The instrument sub has a length shorter than a length of the pump. The instrument sub may have a greater outer diameter than outer diameters of the seal section and the pump. A longitudinal recess may extend along an exterior of the instrument sub. A motor lead extending upward from the motor to a power cable locates in the recess.

The instrument sub has a housing with a bore that is coaxial with a longitudinal axis of the pump and the seal section. Rather than a larger diameter housing, the housing may have a cylindrical exterior that is eccentric relative to the bore. The eccentric outer diameter defines a thinner wall thickness portion of the housing and a thicker wall thickness portion of the housing on an opposite side of the housing from the thinner wall thickness portion. The motor lead extends alongside the thinner wall thickness portion of the housing. The sensor line port is located in the thicker wall portion of the housing.

The diffuser of the pump stage in the instrument sub has flow passages for receiving well fluid. The sensor is mounted in one of the flow passages of the diffuser. A diffuser port extends through a portion of the diffuser. The sensor line extends through the diffuser port to the sensor.

The diffuser has an annular seal mounted to an outer diameter of the diffuser and in sealing engagement with an inner diameter of the housing. A longitudinal groove is formed selectively in the outer diameter of the diffuser or the inner diameter of the housing. The groove extends from the sensor line port past the annular seal to the diffuser port. The sensor line extends from the sensor line port along the groove and through the diffuser port to the sensor. The groove is filled with a sealant to prevent leakage of well fluid past the annular seal.

The instrument sub may have a housing having a bolt pattern on at least one end for bolting to the pump. A shaft is mounted within the housing with radial bearings for coupling to a shaft assembly extending from the motor.

DETAILED DESCRIPTION OF THE DISCLOSURE

Figure 1:
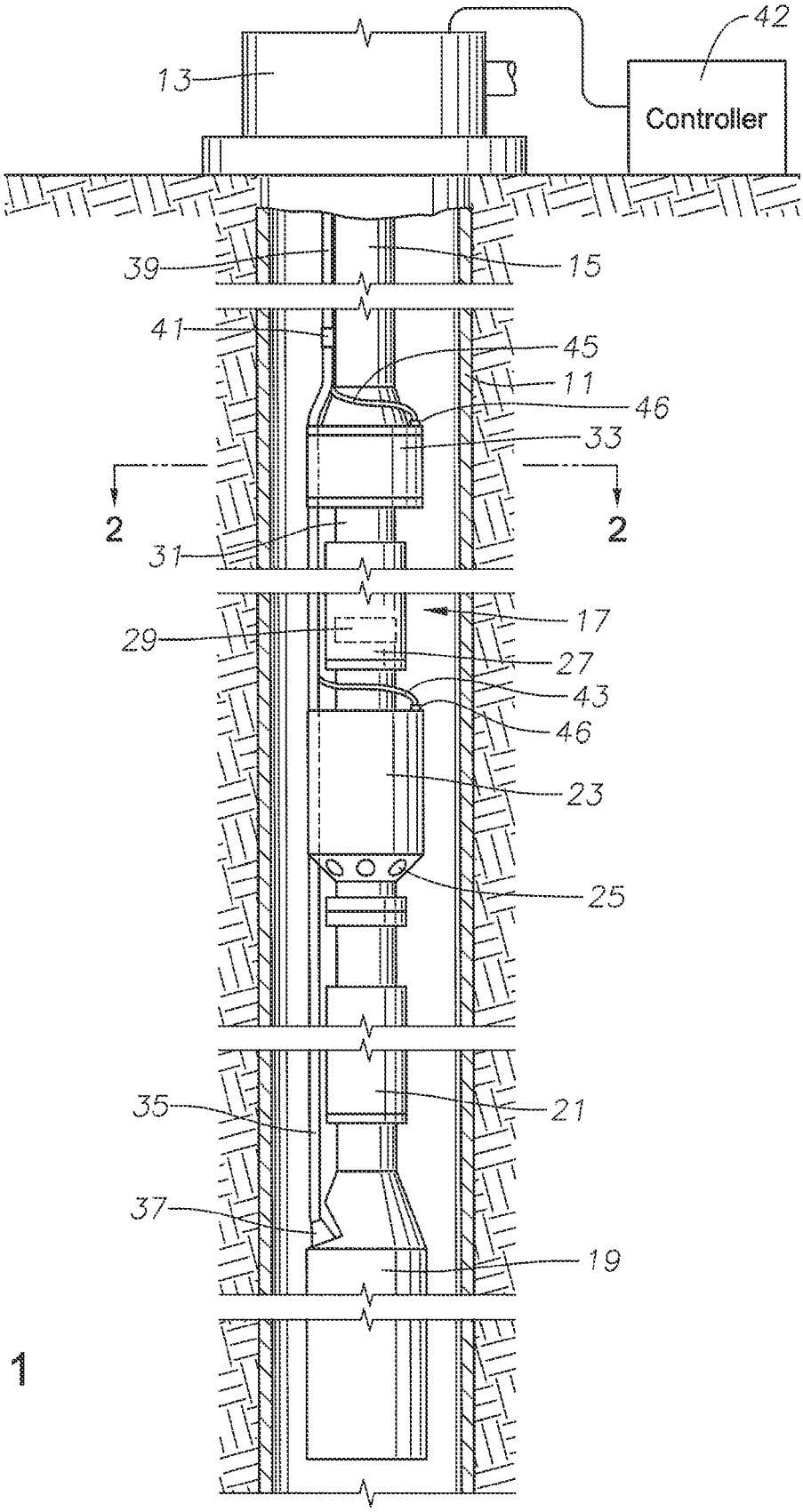
FIG. 1 is a schematic side view of a well pump assembly in accordance with this disclosure.

Referring to FIG. 1, a cased well 11 has a conventional production tree 13 at its upper end. A string of tubing 15 is suspended by tree 13 and extends into the well. Tubing 15 may be sections of tubing secured together with threaded ends, or if may comprise continuous coiled tubing. Tubing 15 supports an electrical submersible pump assembly (ESP) 17.

ESP 17 includes a motor 19, illustrated at its lower end. Motor 19 is normally a three-phase electrical motor, but it could be a DC motor or a hydraulic or gas powered motor. A seal section 21 is secured to the upper end of motor 19. Seal section 21 is a conventional device that has means within, such as a bladder or bellows, for reducing pressure differential between the lubricant in motor 19 and well fluid in well 11. Seal section 21 could be formed as a part of motor 19, and may include a thrust bearing.

In this embodiment, a lower instrument sub 23 is coupled above an intake member 25, which in turn, is coupled to the upper end of seal section 21. The upper end of lower instrument sub 23 connects to a primary pump 27. Lower instrument sub 23 has at least one pump stage, thus could be considered to be a secondary pump. Primary pump 27 has a large number of pump stages 29 compared to the instrument sub; several hundred pump stages 29 could be employed in primary pump 27. Primary pump 27 could comprise tandem pumps connected together. Primary pump 27 is preferably a centrifugal pump, with each pump stage 29 comprising an impeller and a diffuser.

Primary pump 27 includes a discharge adapter 31 on its upper end. In this example, an upper instrument sub 33, which may be identical to lower instrument sub 23, connects to discharge adapter 31. The upper end of upper instrument sub 33 connects to tubing 15.

A motor lead 35 has a connector 37 on its lower end that connects to the upper end of motor 19. Motor lead 35 has an upper end that connects via a connector or splice 41 to power cable 39. Splice 41 is normally located above ESP 17. Power cable 39 extends alongside tubing 15 to production tree 13, and from production tree 13 to a controller 42 adjacent production tree 13. Clamps or straps (not shown) connect power cable 39 to tubing 15 at various distances to transfer the weight of power cable 39 to tubing 15. Controller 42 supplies power down power down power cable 39 and motor lead 35 to motor 19. If the power is hydraulic or gas, it will be supplied down a power conduit to motor 19. Controller 42 may also have a variable speed drive system for varying the frequency of the power supplied and thus the rotational speed of motor 19. In addition, controller 42 has circuitry for receiving sensed information from instrument subs 23, 33 concerning operating parameters of ESP 17. That information may be displayed and/or transmitted to remote locations.

In this example, a sensor line 43 connects lower instrument sub 23 to controller 42 to communicate information sensed. Similarly, a sensor line 45 connects upper instrument sub 33 to controller 42. Sensor lines 43, 45 may comprise separate instrument wires from motor lead 35 and power cable 39 and extend continuously along with power cable 39 to controller 42. Sensor lines 43, 45 may join each other at or below splice 41 and comprise a single sensor line extending alongside power cable 39. Sensor lines 43, 45 may be electrical wires conveying power to sensors in instrument subs 23, 33 and transmitting electrical signals from the sensors. Alternately, sensor lines 43, 45 may comprise fiber optic lines that transmit light signals from fiber optic sensors in instrument subs 23, 33.

Sensor line 43 sealingly passes through a sensor line port 46 formed in the wall of lower instrument sub 23. Similarly, sensor line 45 passes through a sensor line port 46 in the wall of upper instrument sub 33. Each sensor line port 46 is preferably spaced 180 degrees from motor lead 35.

Figure 2:
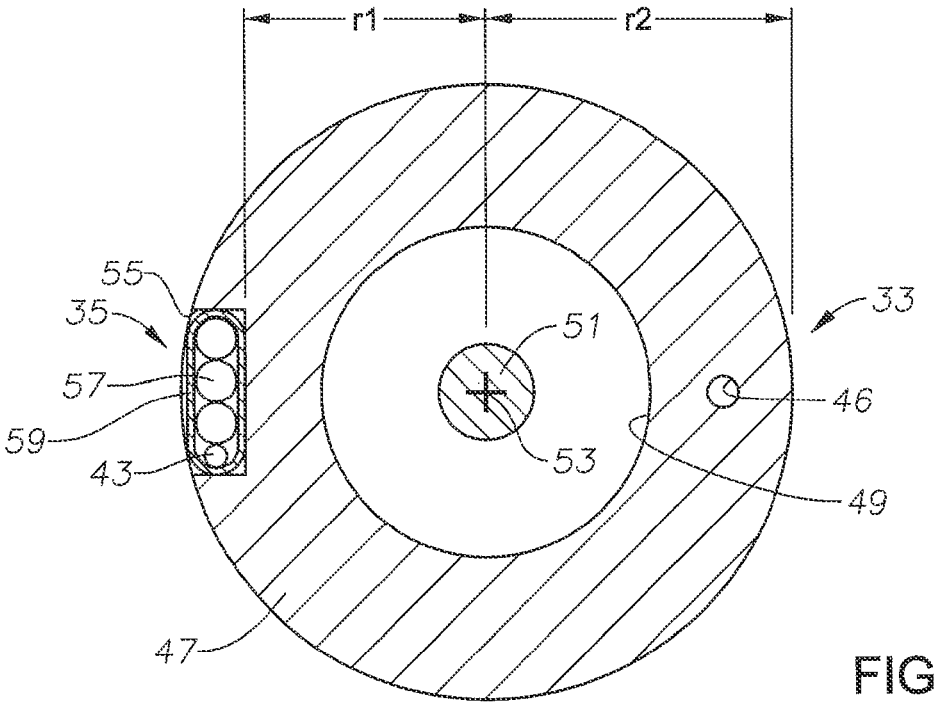
FIG. 2 is a sectional view of one of the instrument subs of the pump assembly of FIG. 1, taken along the line 2-2 of FIG. 1 and with the instrument pump stages not shown.
Figure 3:
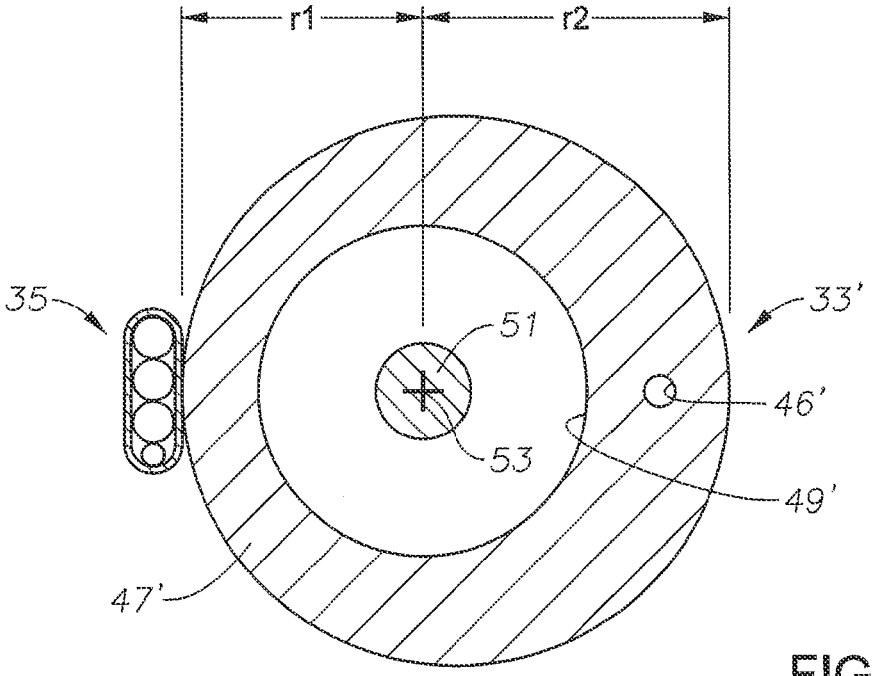
FIG. 3 is a sectional view similar to FIG. 2, but showing an alternate embodiment of a housing for the instrument sub.

Referring to FIG. 2, upper instrument sub 33 has a cylindrical housing 47 with a bore 49 that is coaxial with a longitudinal axis 53 of ESP 17 (FIG. 1). The following description of upper instrument sub 33 as shown in FIGS. 2 and 3 is also applicable to lower instrument sub 23, which may be identical. A rotatable drive shaft 51 is centered on axis 53 within bore 49 and is part of a shaft assembly extending upward from motor 19 (FIG. 1) for driving primary pump 27. In FIG. 2, the outer diameter of housing 47 is concentric with axis 53 and also is of a larger diameter than the outer diameters of seal section 21 and pump 27. Preferably, the outer diameter of instrument sub housing 47 is the same as the outer diameter of motor 19. The minimum inner diameter of bore 49 may be the same as the inner diameter of the housing for primary pump 27 and seal section 21. The increase in outer diameter creates a greater wall thickness for instrument sub housing 47 than the wall thickness of primary pump 27 and seal section 21. The greater wall thickness accommodates sensor line port 46.

One reason for primary pump 27 and seal section 21 having a smaller outer diameter than motor 19 is to provide for the passage alongside of motor lead 35. Often the difference in diameter between motor 19 and the inner diameter of cased well 11 is quite small. If primary pump 27 and seal section 21 had diameters equal to motor 19, there may not be enough room for motor lead 35 to be located alongside. Motor lead 35 does not extend alongside motor 19, thus motor 19 may have a larger diameter than pump 27 and seal section 21.

A longitudinally extending groove or recess 55 is formed in the exterior of upper instrument sub housing 47 to receive motor lead 35. Motor lead groove 55 has a depth approximately the same as the thickness of motor lead 35. Alternately, a flat could be formed in place of groove 55. Motor lead groove 55 is located 180 degrees from sensor line port 46. The radial distance r1 from axis 53 to the base of motor lead groove 55 is less than the radial distance r2 from axis 53 to the exterior of instrument sub housing 47 at a point 180 degrees from motor lead groove 55. The larger distance r2 results in a greater wall thickness of housing 47 adjacent sensor line port 46 than would occur if housing 47 with its concentric bore 49 had the same outer diameter as primary pump 27. Housing 47 is much shorter than primary pump 27, thus making a greater wall thickness more feasible than if applied to primary pump 27.

As shown in FIG. 2, motor lead 35 has at least one and normally three insulated power conductors 57 extending side-by-side parallel to each other. An outer armor 59 formed of a metal strip may wrap helically around the three conductors 57. Alternately, the three conductors 57 could be located in separate metal tubes. Lower sensor line 43 could be located within armor 59 or on the exterior.

FIG. 3 illustrates an alternate embodiment of upper instrument sub 33' to FIG. 2 in that the outer diameter of instrument sub housing 47' need not be larger than the outer diameters of primary pump 27 and seal section 21. In this embodiment, bore 49' is concentric with axis 53. However, the exterior of housing 47' is eccentric relative to axis 53, resulting in an outer diameter that is eccentric to bore 49'. The wall thickness of housing 47' gradually increases from one side to another. This embodiment does not have a motor lead groove, such as groove 55 (FIG. 2) for motor lead 35. Rather, motor lead 35 extends alongside and may touch the exterior of housing 47' at a point of minimum thickness. Sensor line port 46' is located in an area of maximum wall thickness 180 degrees from motor lead 35. The radial distance r1 from axis 53 to the point on the exterior of housing 47' at its maximum thickness is less than the radial distance r2 from axis 53 to the point on the exterior of housing 47' at its maximum thickness. In this embodiment, it is not necessary for the exterior of housing 47' to be cylindrical.

Figure 4:
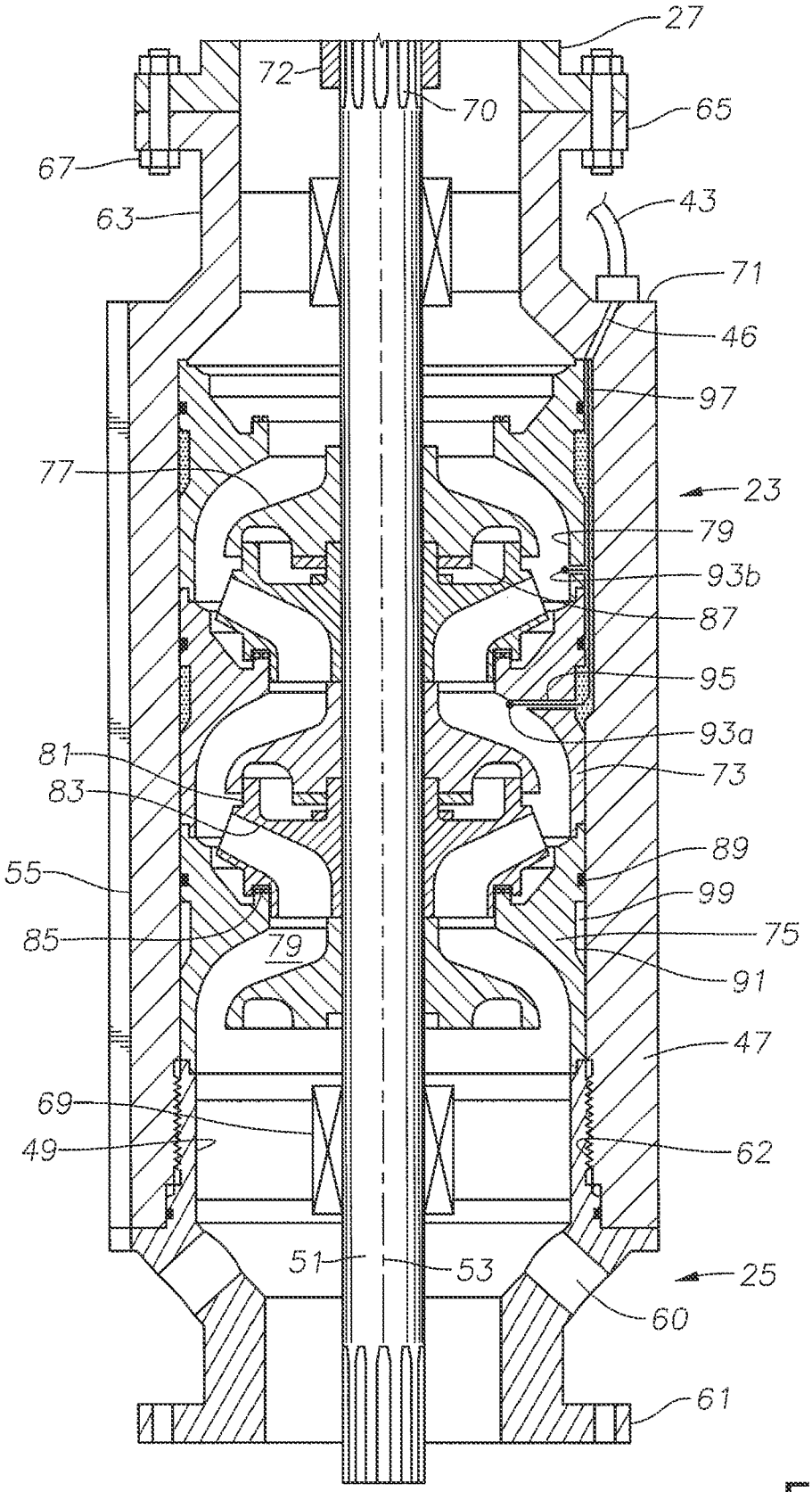
FIG. 4 is a partially schematic axial sectional view of the instrument sub shown in FIGS. 1 and 2.

FIG. 4 illustrates one embodiment of lower instrument sub 23, but the discussion is applicable also to upper instrument sub 33. Some of the numerals used in connection with FIGS. 1 and 2 are utilized in the discussion of FIG. 4 as those components are the same. In this example, intake member 25 is a separate member from lower instrument sub 23, but it could be integral with lower instrument sub housing 47. Intake member 25 is a tubular member with intake ports 60 formed in its side wall. The upper end of intake member 25 is threaded and secures to threads 62 formed in the inner diameter of housing 47. A bolt flange 61 formed on the lower end of intake member 25 receives threaded bolts for bolting intake member 25 to the upper end of seal section 21. Alternately, intake member 25 could have a bolt flange (not shown) on its upper end that bolts to a bolt flange on the lower end of lower instrument sub 23. Also, intake member 25 could be located within a gas separator (not shown), or it could be within an upper portion of seal section 21.

A neck 63 of smaller diameter than the maximum outer diameter of housing 47 extends above housing 47 and has a bolt flange 65 for bolting with threaded fasteners or bolts 67 to a lower end of pump 27. Neck 63 could be a separate component secured by threads to internal threads in housing 47 in the same manner as intake member 25. Radial bearings 69 in housing 47 support shaft 51 radially and may be located adjacent both upper and lower ends of housing 47. Shaft 51 has splines 70 on its upper end that couple with splines on a shaft (not shown) in primary pump 27 via a spline coupling sleeve 72. Torque imposed on shaft 51 thus transmits to the shaft in primary pump 27. The lower end of shaft 51 also has splines 70 for engaging the shaft of seal section 21. There are various other arrangements for connecting lower and upper instrument subs 23, 33 to primary pump 27. For example, union-type threaded sleeves as illustrated in U.S. Pat. No. 6,557,905, may be employed.

Instrument sub housing 47 has at least one shoulder that is generally perpendicular to axis 51. In this example, sensor line port 46 is shown extending through an upward facing shoulder 71. Alternately, sensor line port 46 could extend through a downward facing shoulder in one or both of the instrument subs 23, 33.

Figure 5:
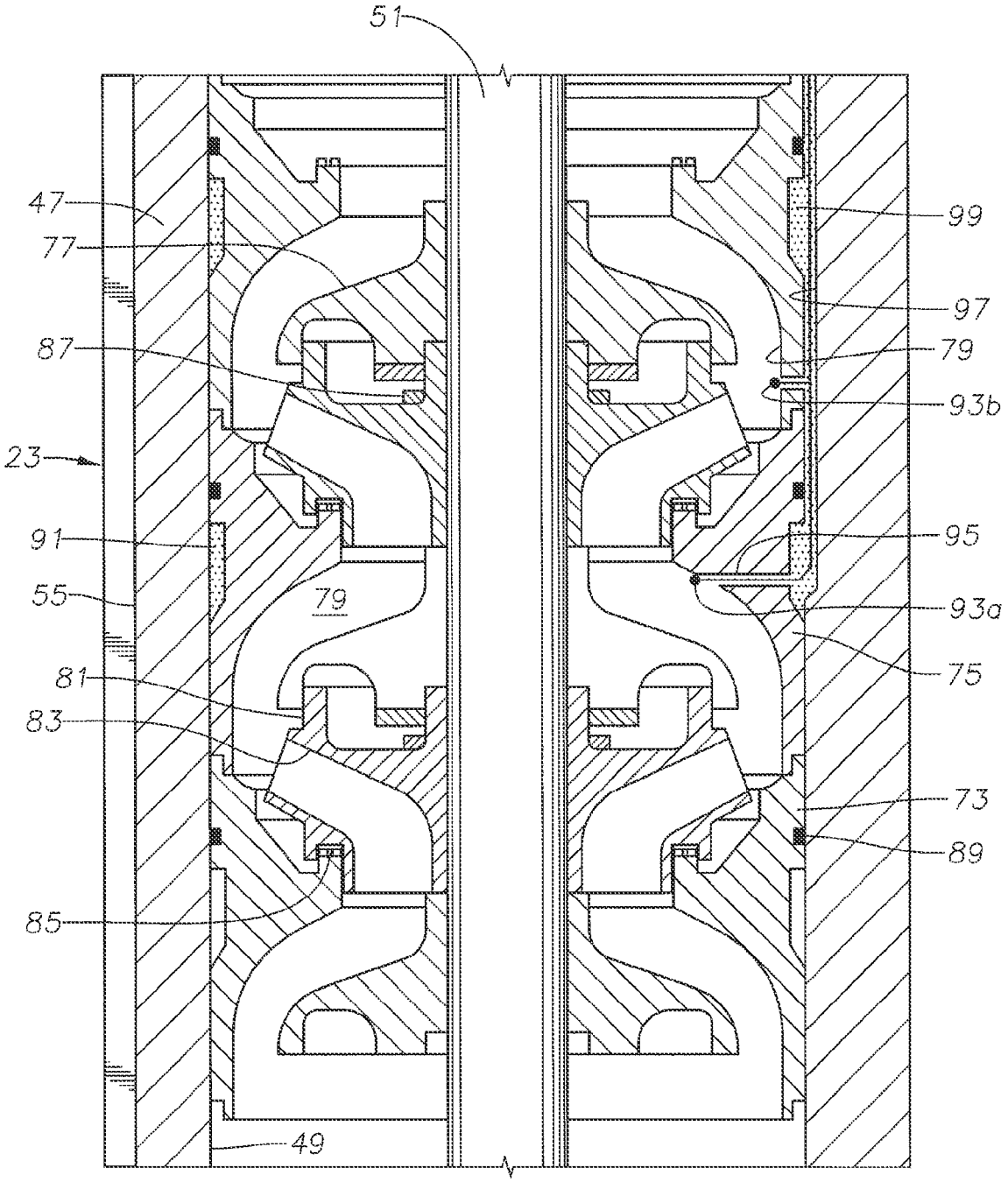
FIG. 5 is a partially schematic enlarged axial sectional view of a portion of the instrument sub shown in FIG. 4.

Referring to FIG. 5, lower instrument sub 23 has a plurality of well fluid pump stages, and the number can vary, but will be much less than the pump stages of primary pump 27. The pump stages of lower instrument sub 23, as well as upper instrument sub 33 (FIG. 1), are preferably identical to those in primary pump 27, but they could differ. In this example, three diffusers 73 are shown stacked on each other and secured against rotation within housing 47. Each diffuser 73 has a shroud 75 with a cylindrical outer diameter closely received in housing 47. Each diffuser has a hub 77 located within shroud 75 and spaced to define flow passages 79 that extend upward and inward.

Two impellers 81 of are shown mated to two of the diffusers 73. In addition, an impeller (not shown) could be located above the top diffuser 73 and another below the bottom diffuser 75. Each impeller 81 has vanes 83 that extend upward and outward and define vane passages for imparting a higher velocity to well fluid received from the diffuser 73 directly below. FIGS. 4 and 5 show a mixed flow pump wherein the impeller vanes 83 extend upward out outward. This disclosure is also applicable to radial flow pump stages where the vanes extend primarily radially outward.

Impellers 81 are keyed to shaft 51 for rotation therewith. Normally, each impeller 81 is free to float axially a short distance on shaft 51. A down thrust washer 85 on each impeller 81 transfers downward directed thrust of each impeller to a mating down thrust washer on the diffuser shroud 75 immediately below. An up thrust washer 87 on each impeller 81 transfers upward directed thrust from each impeller 81 to a lower side of the diffuser hub 77 directly above.

The well fluid pressure increases as the flow fluid flows upward through impellers 81 and diffusers 73. To contain this fluid pressure, each diffuser 73 has an annular seal 89 surrounding the outer diameter of diffuser shroud 75 in sealing engagement with housing bore 49. Optionally, an annular recess 91 may extend around the outer diameter of each diffuser shroud 75.

Lower instrument sub 23, as well as upper instrument sub 33, has a number of sensors 93 for sensing various parameters. These parameters include, but are not limited to, well fluid pressure, temperature, gas content, viscosity, gas percentage, and oil/water ratios. Other parameters include vibration, and shaft proximity to other structures. Sensors 93 may be of a variety of types and may be electrical or electronic, or they may be fiber optic types.

In this example, a sensor 93*a* is illustrated schematically as being mounted in one of the diffuser flow passages 79 adjacent the intake of one of the impellers 81. Another sensor 93*b* is illustrated as being mounted in the diffuser flow passage 79 directly above and in the discharge of the same impeller 81. Thus sensor 93*b* is located in the next upward diffuser 73 from sensor 93*a* in this example.

For each sensor 93, a diffuser sensor port 95 extends from the particular diffuser flow passage 79 through and to the outer diameter of one of the diffuser shrouds 75. Although diffuser sensor ports 95 are shown extending radially, they could extend at other angles relative to axis 51. Each diffuser sensor port 95 leads from one of the sensors 93 to a point generally 180 degrees from motor lead recess 55.

A longitudinal groove 97 has an upper end that registers with sensor line port 71 (FIG. 4). Longitudinal groove 97 extends downward parallel to axis 51 and makes intersections with diffuser sensor ports 95. Groove 97 extends downward past at least one of the diffuser annular seals 89, and in the example shown, past two of them. In this embodiment, groove 97 is a straight open recess formed on the inner surface of bore 49 of housing 47. Alternately, groove 97 could be formed on the outer diameters of diffuser shrouds 75.

Sensor line 43 extends through sensor line port 46 and down longitudinal groove 97. Sensor line 43 bends at the junction with one of the diffuser sensor ports 95 and extends to sensor 93*a*. The same or a different sensor line 43 extends to sensor 93*b*. Once sensor lines 43 have been installed, a sealant 99 is pumped down sensor line port 46 and longitudinal groove 97. Sealant 99 flows along groove 97 past the junctions with diffuser annular seals 89. Sealant 99 may also enter and even fill diffuser annular recesses 91. Sealant 99 cures, blocking any leak paths past diffuser annular seals 89. As an alternate to sealant 99, jogs could be machined around any junctions of groove 97 with diffuser annular seals 89.

Although only two sensors 93 are shown, each instrument sub could contain others. For example, as illustrated in US 2013/0148127, optic fiber sensors could be located at thrust washers 85 and 87 to monitor thrust. Sensors could also be located at the interfaces between shaft 51 and diffuser hubs 77 to monitor vibration. Sensors could also be located in the annular recesses 91 to monitor temperature and pressure within this area.

While the disclosure has been shown and described in only a few of its forms, it should be apparent to those skilled in the art that it is not so limited but is susceptible to various changes without departing from the scope of the disclosure.

The invention claimed is:

1. An electrical submersible pump assembly, comprising:

a centrifugal pump;

an electrical motor operatively coupled to the pump;

a seal section disposed between the pump and the motor for sealing lubricant within the motor;

at least one instrument sub releasably secured to one end of the pump above an intake of the pump;

at least one pump stage in the at least one instrument sub, the at least one pump stage comprising an impeller and a diffuser configured for pumping well fluid;

at least one sensor within the at least one instrument sub for monitoring parameters in the at least one instrument sub;

a motor lead having power conductors, the motor lead being connected to an upper end of the motor and extending alongside the seal section, the at least one instrument sub and the pump;

at least one sensor line extending sealingly through a sensor line port in the at least one instrument sub to the at least one sensor for conveying sensed information from the at least one sensor to a remote instrument panel; and the at least one sensor line bundling with and extending alongside the power conductors of the motor lead upward from the at least one instrument sub.

2. The assembly according to claim 1, wherein the at least one instrument sub has a length shorter than a length of the pump.

3. The assembly according to claim 1, wherein:

the instrument sub has a greater outer diameter than outer diameters of the seal section and the pump;

a longitudinal recess extends along an exterior of the at least one instrument sub; and wherein a portion of the motor lead locates in the recess.

4. The assembly according to claim 1, wherein:

the at least one instrument sub has a housing with a bore that is coaxial with a longitudinal axis of the pump and the seal section;

the housing has a cylindrical exterior that is eccentric relative to the bore, defining a thinner wall thickness portion of the housing and a thicker wall thickness portion of the housing on an opposite side of the housing from the thinner wall thickness portion; and the motor lead extends alongside the thinner wall thickness portion of the housing.

5. The assembly according to claim 1, wherein:

the at least one instrument sub has a housing with a cylindrical exterior having a greater outer diameter than outer diameters of the seal section and the pump;

the housing has a bore that is coaxial with a longitudinal axis of the pump, the seal section, and the bore;

the exterior of the housing is eccentric relative to the bore, defining a thinner wall thickness portion of the housing and a thicker wall thickness portion of the housing on an opposite side of the housing; and the sensor line port is located in the thicker wall thickness portion of the housing.

6. The assembly according to claim 1, wherein:

the at least one instrument sub has at least one shoulder located in a plane perpendicular to a longitudinal axis of the at least one instrument sub; and the sensor line port extends through the shoulder.

7. The assembly according to claim 1, wherein:

the at least one instrument sub has a cylindrical housing;

the diffuser in the at least one instrument sub has flow passages for receiving well fluid;

the at least one sensor is mounted in one of the flow passages of the diffuser;

an annular seal is mounted to an outer diameter of the diffuser and in sealing engagement with an inner diameter of the housing;

a diffuser port extends through a portion of the diffuser to the outer diameter of the diffuser;

a longitudinal groove is formed selectively in the outer diameter of the diffuser and the inner diameter of the housing, the groove extending from the sensor line port past the annular seal to the diffuser port;

the at least one sensor line extends from the sensor line port along the groove and through the diffuser port to the at least one sensor; and the groove is filled with a sealant to prevent leakage of well fluid past the annular seal.

8. The assembly according to claim 1, wherein the at least one instrument sub comprises:

a housing having a bolt pattern on at least one end for bolting to the pump; and a shaft mounted within the housing with radial bearings for coupling into a shaft assembly extending from the motor.

9. The assembly according to claim 1, wherein the at least one instrument sub is mounted to a lower end of the pump above the seal section; and the assembly further comprises:

an upper instrument sub mounted to an upper end of the pump, the upper instrument sub comprising:

at least one upper instrument sub pump stage, the upper instrument sub pump stage comprising an upper instrument sub impeller and an upper instrument sub diffuser configured for pumping well fluid discharged by the pump; and at least one upper instrument sub sensor in the upper instrument sub for monitoring parameters in the upper instrument sub.

10. An electrical submersible pump assembly, comprising:

a centrifugal pump;

an electrical motor operatively coupled to the pump;

a seal section disposed between the pump and the motor for reducing a pressure differential between well fluid on an exterior of the motor and lubricant within the motor;

at least one instrument sub releasably secured to one end of the pump above an intake of the pump;

at least one pump stage in the at least one instrument sub, the at least one pump stage comprising an impeller and a diffuser configured for pumping well fluid;

at least one sensor within the at least one instrument sub for monitoring parameters in the at least one instrument sub;

at least one sensor line extending sealingly through a sensor line port in the at least one instrument sub to the at least one sensor for conveying sensed information from the at least one sensor to a remote instrument panel; wherein the diffuser of the at least one pump stage in the at least one instrument sub has flow passages for receiving well fluid;

the at least one sensor is mounted in one of the flow passages of the diffuser;

a diffuser port extends through a portion of the diffuser; and the at least one sensor line extends through the diffuser port to the at least one sensor.

11. An electrical submersible pump assembly, comprising:

a centrifugal primary pump having a primary pump housing;

an electrical motor operatively coupled to the primary pump;

a seal section disposed between the primary pump and the motor for sealing lubricant within the motor;

at least one instrument sub, comprising:

an instrument sub housing secured by at least one threaded fastener to one end of the primary pump housing;

a pump stage in the instrument sub housing driven by the electric motor along with the primary pump, the pump stage comprising an impeller and a diffuser;

at least one sensor within the at least one instrument sub for monitoring parameters in the at least one instrument sub;

a sensor line port extending through a wall of the instrument sub housing;

a motor lead having power conductors, the motor lead being connected to an upper end of the motor and extending alongside the seal section, the at least one instrument sub and the pump;

at least one sensor line extending sealingly through the sensor line port to the at least one sensor for conveying sensed information from the at least one sensor to a remote instrument panel; and the at least one sensor line bundling with and extending alongside the power conductors of the motor lead upward from the at least one instrument sub.

12. The assembly according to claim 11, wherein the instrument sub is secured between an intake for the primary pump and a lower end of the primary pump; and wherein the assembly further comprises:

an upper instrument sub having an upper instrument sub pump stage and secured to an upper end of the primary pump, the upper instrument sub pump stage receiving well fluid that is discharged by the primary pump, and the upper instrument sub further comprises:

at least one upper instrument sub sensor in the upper instrument sub for monitoring parameters in the upper instrument sub.

13. The assembly according to claim 11, wherein:

the at least one instrument sub has an exterior with a motor lead side potion that is in contact with the motor lead;

the sensor line port is spaced 180 degrees from the motor lead side portion; and a portion of the exterior of the at least one instrument sub spaced 180 degrees from the motor lead side portion is located radially farther from a longitudinal axis of the at least one instrument sub that the motor lead side portion.

14. The assembly according to claim 11, wherein:

the exterior of the at least one instrument sub has a greater outer diameter than outer diameters of the seal section and the primary pump;

a longitudinal recess extends along an exterior of the instrument sub housing; and a portion of the motor lead locates in the recess.

15. The assembly according to claim 11, wherein:

the instrument sub housing has a bore that is coaxial with a longitudinal axis of the primary pump housing;

the instrument sub housing has a cylindrical exterior that defines a thinner wall thickness portion and a thicker wall thickness portion of the instrument sub housing;

the motor lead extends alongside the thinner wall thickness portion of the instrument sub housing; and the sensor line port is located in the thicker wall thickness portion of the instrument sub housing.

16. The assembly according to claim 11, wherein:

an annular seal is mounted to an outer diameter of the diffuser and in sealing engagement with an inner diameter of the instrument sub housing;

a diffuser port extends through a portion of the diffuser;

a longitudinal groove is formed selectively in the outer diameter of the diffuser and the inner diameter of the instrument sub housing, the groove registering with the sensor line port and extending past the annular seal to the sensor line port;

the at least one sensor line extends from the sensor line port along the groove, past the annular seal, and through the diffuser port to the at least one sensor; and the groove is filled with a sealant to prevent leakage of well fluid past the annular seal.

17. An electrical submersible pump assembly, comprising:

a centrifugal primary pump having a primary pump housing containing a plurality of primary pump stages;

an electrical motor operatively coupled to the primary pump;

a seal section disposed between the primary pump and the motor for reducing a pressure differential between well fluid on an exterior of the motor and lubricant within the motor;

at least one instrument sub, comprising:

an instrument sub housing secured by at least one threaded fastener to one end of the primary pump housing;

a primary pump intake located below the instrument sub housing;

a shaft assembly rotated by the motor and extending through the seal section, the instrument sub housing, and the primary pump;

a plurality of instrument sub pump stages in the instrument sub housing, each of the instrument sub pump stages comprising an impeller rotated by the shaft assembly and a diffuser, the instrument sub pump stages being fewer in number than the primary pump stages;

at least one sensor within the at least one instrument sub for monitoring parameters in the at least one instrument sub;

a sensor line port extending through a wall of the instrument sub housing;

at least one sensor line extending sealingly through the sensor line port to the sensor for conveying sensed information from the sensor to a remote instrument panel;

a motor lead connected to an upper end of the motor and extending alongside the seal section, the at least one instrument sub, and the primary pump; wherein the instrument sub housing has an exterior with a motor lead side portion that is in contact with the motor lead;

the sensor line port is spaced 180 degrees from the motor lead side portion; and a portion of the exterior of the instrument sub housing spaced 180 degrees from the motor lead side portion is located radially farther from a longitudinal axis of the instrument sub housing that the motor lead side portion.

18. The assembly according to claim 17, wherein:

each of the diffusers has a plurality of flow passages; and the sensor is mounted within one of the flow passages of at least one of the diffusers.

19. The assembly according to claim 17, wherein:

the exterior of the instrument sub housing is concentric with the longitudinal axis and has a greater outer diameter than the seal section and the pump; and the motor lead portion comprises:

a longitudinally extending groove.

20. The assembly according to claim 17, wherein:

the exterior of the instrument sub housing is eccentric relative to the longitudinal axis.

* * * * *